United States Patent [19]

Edson

[11] Patent Number: 4,663,005

[45] Date of Patent: May 5, 1987

[54] ELECTROPOLISHING PROCESS

[76] Inventor: Gwynne I. Edson, 20701 Beach Blvd., #286, Huntington Beach, Calif. 92648-4930

[21] Appl. No.: 903,159

[22] Filed: Sep. 3, 1986

Related U.S. Application Data

[63] Continuation-in-part of Ser. No. 798,578, Nov. 15, 1985.

[51] Int. Cl.[4] ..... C25F 3/16

[52] U.S. Cl. ..... 204/129.85

[58] Field of Search ..... 204/129.85, 129.95

[56] References Cited

U.S. PATENT DOCUMENTS 3,389,065 6/1968 Shibasaki ..... 204/129.85

*Primary Examiner*—T. M. Tufariello

*Attorney, Agent, or Firm*—Roberts and Quiogue

[57] ABSTRACT

An electrolytic process employing a non-toxic electrolytic solution for anodically producing a high surface luster on copper, silver, gold, and alloys of the same is disclosed. The electrolytic solution employs thiourea as the principal carrier electrolyte, which is then stabilized using large quantities (50 to 400 gram per liter) of a reducing sugar. In addition, the preferred formulation of the solution uses an activating acid to activate the thiourea solution and urea to promote the uniform dissolution of alloying elements and to provide solution conductivity. The electropolishing processes employing the electrolytic solutions are environmentally safe, operate over broad current density ranges, are rapid in operation, and are functional on irregular shapes and complex designs. Certain other acids can be substituted for the methane sulfonic acid obtaining similar results with selected alloys of gold and silver.

12 Claims, 1 Drawing Figure

ELECTROPOLISHING PROCESS

This is a continuation-in-part of application Ser. No. 798,578, filed on Nov. 15, 1985.

BACKGROUND OF THE INVENTION

The invention relates to an improved electrolytic process for electropolishing of precious metals, base metals, and alloys thereof, and particularly to a process for producing a high surface luster on metallic items by anodic immersion in a non-cyanide solution.

While acidified thiourea solutions have been used for years to chemically dissolve gold, silver, copper and other metals, the presence of an oxidizing agent quickly caused the solutions to break down, producing elemental sulfur and rendering the solution useless. When electrolysis is applied to these solutions in the electrolytic cell, as used for the deposition of metals as in electroplating, a reduction reaction takes place at the cathode and an oxidation reaction at the anode. If both the anodic and cathodic reactions are used to deposit metal at the cathode and dissolve metal at the anode, they are said to be 100% efficient, and no other oxidation or reduction reactions would take place. In electropolishing systems, however, the current applied to the workpiece (the anode) far exceeds what can be used to dissolve metals, and other oxidations reactions are initiated. This is evidenced by the production of oxygen gas which is evolved from the workpiece. The oxygen which is produced at the anode quickly causes the solution to break down in much the same manner as described for chemical dissolution. Another known type of electrolyte, cyanide electrolytes, which has been used to electrochemically dissolve gold, silver, and copper, not only is extremely toxic but is also subject to anodic oxidation. Further, the oxidation process for cyanide electrolytes is far slower than for the unprotected thiourea electrolyte.

It is therefore one object of the invention to provide an improved electropolishing process which employs a nontoxic electroltye and operates quickly and efficiently as a stripper of ferrous metal alloys.

Another object of this invention is to provide a environmentally safe process for the dissolving of metallic silver, gold, copper, and alloys of the same.

Yet a further object of the invention is to provide an electropolishing solution for producing a high lustrous finish of objects made of silver, gold, copper, or alloys of the same, and which is non-toxic and environmentally safe to operate and dispose of when exhausted.

Another object of the invention is to provide an environmentally safe process for removing coating of silver, gold, copper, or alloys of the same from parts made of stainless steel, or other ferrous alloys.

SUMMARY OF THE INVENTION

These and other objects, features and advantages of the invention are accomplished by the electropolishing process disclosed herein.

A process for dissolving gold, silver, copper, and alloys of the same by anodic immersion in a nontoxic electrolyte is described. Dissolution of the above materials is accomplished in such a manner that the underlying surface of the metal is modified to produce a highly lustrous surface. A process is also described wherein one metal can be electrolytically removed from a different underlying metal without damage to the underlying metal. These processes are environmentally safe, operate over broad current density ranges, are rapid in operation, and are functional on irregular shapes and complex designs.

The electrolytic solution used in these processes is formulated using one or more electrolytes selected for the metal (or alloy) being processed. The preferred principal carrier electrolyte for gold or silver items is thiourea. When the item being processed is an alloy of these metals, a secondary carrier electrolyte may be used. An acid is added to activate the thiourea, to provide a solvent for alloying elements and provide solution conductivity. The acid found suitable for the widest range of metals and alloys is methane sulfonic acid. Other acids are acceptable for application on specific alloys. The stabilize the anodic decomposition of thiourea, reducing sugars and urea are added in large quantities. This controls the production of the oxidation products of the reaction.

Ranges of chemical compositions of the electrolyte and the ranges of process operating conditions are described for such applications as stripping and electropolishing gold, copper and their alloys, and stripping and electropolishing silver and its alloys.

BRIEF DESCRIPTION OF THE DRAWINGS

These and other features and advantages of the present invention will become more apparent from the following detailed description of an exemplary embodiment thereof, as further illustrated in the accompanying drawing, in which.

DETAILED DESCRIPTION

Figure 1:
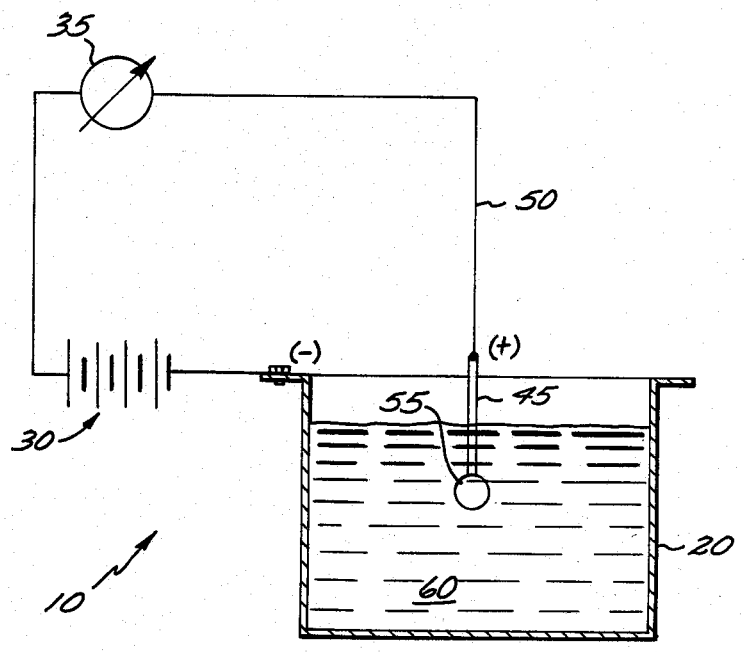
FIG. 1 is a diagrammatic diagram of an electropolishing system which may be used to implement the invention.

The preferred embodiments are employed with an electrolytic polishing apparatus 10 such as is depicted in FIG. 1. The apparatus includes a container vessel, preferably constructed of titanium, in which the electrolytic solution 60 and the workpiece to be polished are disposed. Alternatively, a plastic tank with titanium cathodes may be employed as vessel 20. A stainless steel tank may be employed, although the stainless steel may reduce the life and performance of the electrolytic solution.

The workpiece 55 is suspended in the electrolytic solution 60 by rack 45, preferably constructed of titanium, and wiring 50. Wiring 50 is coupled to the anode of DC power supply 30, through a power controller device 35. The cathode of the power source 30 is connected to the cathode of vessel 20 in such a manner as to promote a uniform current density between the vessel cathode and the workpiece 55 which serves as the anode of the electrolytic process. The power supply should preferably be capable of producing a potential difference of at least 12 volts at a current rating equal to 5 to 10 amperes per workpiece to be processed. A solid state, constant current DC power supply is preferred for ease of control of the process.

Means are provided for maintaining the temperature of the solution 60 at a desired temperature in the vessel 20, e.g., heating and cooling coils adjacent the inner walls of the vessel 20. Means (not shown) for mechanically agitating the electrolyte solution in vessel 20, such as a stirring implement, are also provided. The agitation of the solution provided is preferably rapid and uniform. In some applications, ultrasonic agitation has been found advantageous.

The electrolytic solutions employed according to the invention employs thiourea as the base ingredient. An acid is added to activate the thiourea, provide a solvent for the alloying elements and provide solution conductivity. The acid found suitable for the widest range of metals and alloys is methane sulfonic acid. Other acids are acceptable for application on specific alloys.

Reducing sugars and urea are added to the solution in large quantities to stabilize the anodic decomposition of thiourea. Wetting agents or surfactants may also be employed to promote the uniform electropolishing of workpieces having complex surfaces. Examples of surfactants are glycerin and the product marketed under the trademark "Surfynol #463" by Air Products Corporation, Allentown, Pennsylvania.

The electrolytic solution is generally suitable for use in an electrolytic process for dissolving copper, copper alloys, gold and gold alloys and silver and silver alloys, where the surface removal of the metal causes the underlying surface to develop a high surface luster. The following chemical composition is formulated by adding the following materials to dionized or distilled water (of a volume equal to one-half the desired volume of the electrolytic solution):

thiourea: 50 to 400 grams per liter of solution;
urea: 25 to 200 grams per liter of solution;
reducing sugar: 50 to 400 grams per liter of solution; and
activating acid: 20 to 150 milliliters per liter of solution.

The electrolytic solution is employed in an electrolytic process wherein the workpiece is made anodic in a DC circuit while immersed in the solution which is maintained at 70 to 180 degrees Fahrenheit, while a current density of 10 to 200 amperes per square foot ("ASF") is maintained.

The solution will provide satisfactory results if the urea is omitted. In this case, the solution should be maintained in the 160° F. temperature range.

The reducing sugar may be selected from among the common reducing sugars such as fructose, maltose, dextrose, lactose or sucrose. The activating acid may be selected from among the group of acids comprising methane sulfonic acid, sulfuric acid, hydrocloric acid, phosphoric acid, fluoboric acid and succinic acid.

Specific ranges of chemical compositions of the electrolytic solution and the ranges of operating conditions may be described with reference to two examples.

FIRST EXAMPLE

An electrolytic solution for use in an electrolytic process or workpieces made from copper, copper alloys, gold or gold alloys:

thiourea: 200 grams per liter of solution;
dextrose: 200 grams per liter of solution;
urea: 100 grams per liter of solution;
glycerin: 30 to 60 milliliters per liter of solution;
surfynol #463: 30 to 60 milliliters of a 1% concentration per liter of solution; and
methane sulfonic acid: 20 to 100 milliliters per liter of solution.

This electrolytic solution is used as the electrolyte in an electrolytic process wherein the workpiece is made anodic, and the electrolyte is operated at a temperature of 70 to 85 degrees Fahrenheit with an applied current density of 50 to 100 ASF. This may typically be accomplished with an applied potential difference between the workpiece (anode) and the cathode of 6 to 12 volts.

SECOND EXAMPLE

An electrolytic solution for use in an electrolytic process on workpieces made from silver or silver alloys:

thiourea: 100 grams per liter of solution;
glucose: 100 grams per liter of solution;
urea: 50 grams per liter of solution; and
Methane sulfonic acid: 10 to 25 milliliter per liter of solution.

This electrolytic solution is used in an electrolytic process wherein the workpiece is made anodic in a d.c. circuit while immersed in the solution, which is maintained at 70 to 85 degrees Fahrenheit with an applied current density of 25 to 75 ASF. This current density may typically be achieved by application of potential difference between the anode and cathode of 6 to 12 volts. The surfactants glycerin and surfynol #463 are also useful additions to the solution for electropolishing silver and silver alloys.

The electrolytic solution may be prepared in the vessel 20 (shown in FIG. 1). An exemplary procedure for preparing the solution comprises the following steps:

1. Place a volume of deionized or distilled water in the vessel equal to one-half of the desired final solution volume.
2. Provide mechanical stirring and warm the water to a temperature between 80°–100° F.
3. Add the thiourea and reducing sugar to the water slowly. The addition of these materials will cool the solution, so it is desireable to maintain the temperature while adding the thiourea and reducing sugars slowly.
4. When the thiourea and reducing sugars have all dissolved and the solution temperature has fallen to 85° F. or less, add the activator acid.

A typical operating procedure employing the prepared electrolytic solution in an electropolishing process comprises the following steps:

1. The negative output of the DC power supply is connected to the metal vessel 20 (or to the cathodes in a plastic tank). The workpiece to be processed is connected to the positive output of the DC power supply. The shielding of the vessel walls or the placement of electrodes in a plastic vessel should provide a uniform current density to the rack or part being processed.
2. Preset the power supply to 7 volts and immerse the workpiece in the electrolytic solution. Reset the voltage to 5 volts.
3. Agitate the workpiece in the solution for one to three minutes and remove. If a black finish has been produced on some area of the workpiece, the current is too high, or the agitation is too slow. In this case, re-immerse the workpiece in the solution, reduce the current, and continue agitating until the black smut is removed and the part is bright.
4. Immediately after removing the workpiece from the electrolytic solution, the workpiece should be double rinsed in clean distilled or de-ionized water. This eliminates spotting and prevents back etching of the finish by residual acid.

The above-described process may also be employed to strip gold, copper, silver or alloy of the same from an underlying base metal such as stainless steel or a ferrous metal without damaging the underlying base metal.

While preferred embodiments of the invention have been described herein, it will be apparent that various modifications of the specific details may be made without departing from the spirit or scope of the invention.

What is claimed is:

1. A method for electrolytically polishing workpieces of copper, copper alloys, gold, gold alloys, silver and silver alloys comprising the steps of:

(i) providing said workpiece;

(ii) immersing said workpiece in an electrolytic solution comprising thiourea, urea and a reducing sugar in concentrations of 50 to 400 grams per liter each, and an activating acid in concentrations of 20 to 150 milliliters per liter; and (iii) making said workpiece anodic in a DC circuit while maintaining the temperature of said electrolytic solution in the temperature range of 70 to 180 degrees Fahrenheit.

2. The method set forth in claim 1 wherein said reducing sugar is selected from the group consisting of fructose, maltose, dextrose, lactose and sucrose.

3. The method set forth in claim 1 wherein said activating acid from among the group consisting of methane sulfonic acid, sulfuric acid, hydrocloric acid, phosphoric acid, fluoboric acid and succinic acid.

4. The method of claim 1 wherein:

(i) the concentration of thiourea in said solution is about 200 grams per liter;

(ii) said reducing sugar is dextrose at about 200 grams per liter;

(iii) said activating acid is methane sulfonic acid in a concentration of about 50 to 100 milliliters per liter;

(iv) said solution further comprises urea at a concentration of about 100 grams per liter;

(v) said solution is maintained at about 70 to 85 degrees Fahrenheit with a voltage applied between the workpiece and the cathode of said d.c. circuit of between six to twelve volts.

5. The method set forth in claim 4 wherein the workpiece is made of silver or silver alloys, and wherein:

(i) the concentration of thiourea is about 100 grams per liter;

(ii) said reducing sugar is dextrose at a concentration of about 100 grams per liter;

(iii) said solution further comprises urea at a concentration of about 50 grams per liter;

(iv) said activating acid is methane sulfonic acid at a concentration of about 10 to 25 milliliters per liter; and (v) said solution is maintained at about 110 degrees Fahrenheit with a voltage applied between the workpiece and the cathode of the d.c. circuit of between three and nine volts.

6. The method set forth in claim 4 wherein said solution further comprises one or more surfactants.

7. The method set forth in claim 1 further comprising the step of agitating the electrolytic solution while making said workpiece anodic.

8. The method set forth in claim 1 further comprising the step of removing said workpiece from said solution after one to three minutes of making said workpiece anodic while immersing said workpiece.

9. A method for electrolytically polishing workpieces of copper, copper alloys, gold, gold alloys, silver and silver alloys, comprising the steps of:

(i) providing said workpiece;

(ii) immersing said workpiece in an electrolytic solution comprising thiourea and a reducing sugar in concentrations of 50 to 400 grams per liter each, and an activating acid in concentrations of 20 to 150 milliliters per liter; and (iii) making said workpiece anodic in a DC circuit while maintaining the temperature of said electrolytic solution in the temperature range of 150 to 180 degrees Fahrenheit.

10. The method set forth in claim 9 wherein said reducing sugar is selected from the group consisting of fructose, maltose, dextrose, lactose and sucrose.

11. The method set forth in claim 9 wherein said activating acid is selected from the group consisting of methane sulfonic acid, sulfuric acid, hydrocloric acid, phosphoric acid, fluoboric acid and succinic acid.

12. A method for stripping copper, copper alloys, gold, gold alloys, silver, or silver alloys from a stainless steel or ferrous base metal workpiece, comprising the steps of:

(i) providing said workpiece;

(ii) immersing said workpiece in an electrolytic solution comprising thiourea, urea and a reducing sugar in concentrations of 50 to 400 grams per liter each, and an activating acid in concentrations of 20 to 150 milliliters per liter; and (iii) making said workpiece anodic in a DC circuit while maintaining the temperature of said electrolytic solution in the temperature range of 70 to 180 degrees Fahrenheit.

* * * * *